United States Patent [19]

Szabo

[11] 4,226,345

[45] Oct. 7, 1980

[54] PLASTIC GARMENT HANGERS WITH INTEGRALLY MOLDED CLASPS THEREFOR

[75] Inventor: Bela G. Szabo, Carnegie, Pa.

[73] Assignee: Bruce Plastics, Inc., Pittsburgh, Pa.

[21] Appl. No.: 4,936

[22] Filed: Jan. 19, 1979

[51] Int. Cl.[3] ..... A47J 51/097; A47J 51/14

[52] U.S. Cl. ..... 223/91

[58] Field of Search ..... 223/85, 91, 93, 96, 223/92; 24/137 R, 255 R

[56] References Cited

U.S. PATENT DOCUMENTS

| | | | |
|---|---|---|---|
| 3,214,813 | 11/1965 | Goldman | 24/137 R |
| 3,225,978 | 12/1965 | Wach | 223/91 |
| 3,298,073 | 1/1967 | Merfeld | 24/255 R |
| 3,726,452 | 4/1973 | Jaffe | 223/91 |

*Primary Examiner*—George H. Krizmanich
*Attorney, Agent, or Firm*—Samuel Lebowitz

[57] ABSTRACT

A combined garment hanger of molded plastic material composed of a pair of symmetrical lateral arms inclined downwardly from a central head portion and joined at their lower ends to a horizontal supporting bar by corners of relatively large surface area. The arms, bar and corners are structured with thickened marginal edges which embrace webs of lesser thickness. A U-shaped clasp is molded simultaneously and integrally with the hanger at each corner, and is readily severable from the finished hanger by frangible tabs of small dimensions which serve as gates for the plastic material during the molding operation. The clasps serve to clamp a garment to the hanger which may be suspended or supported thereon.

1 Claim, 6 Drawing Figures

Fig. 1
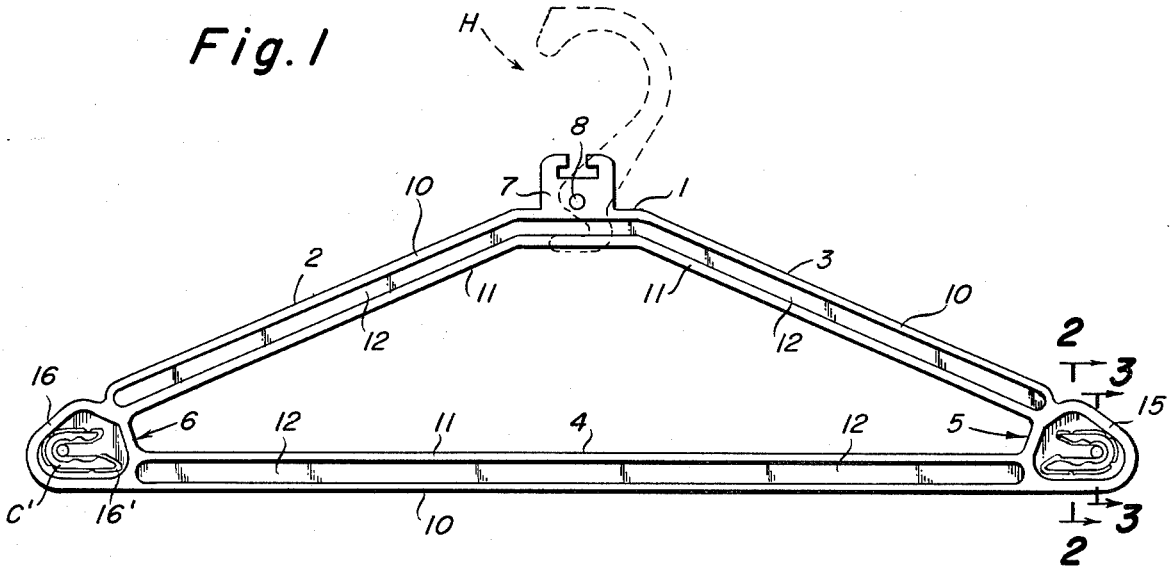
Fig. 2
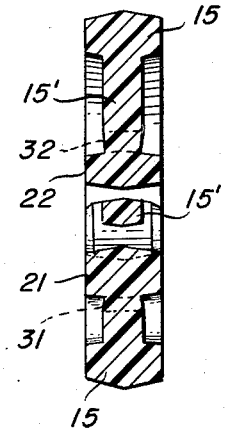
Fig. 3
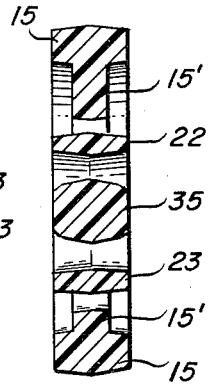
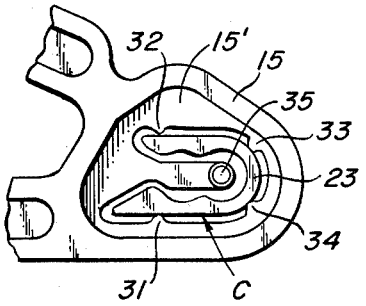
Fig. 4
Fig. 5
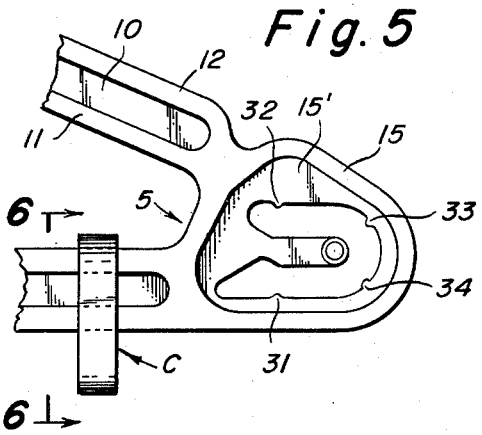
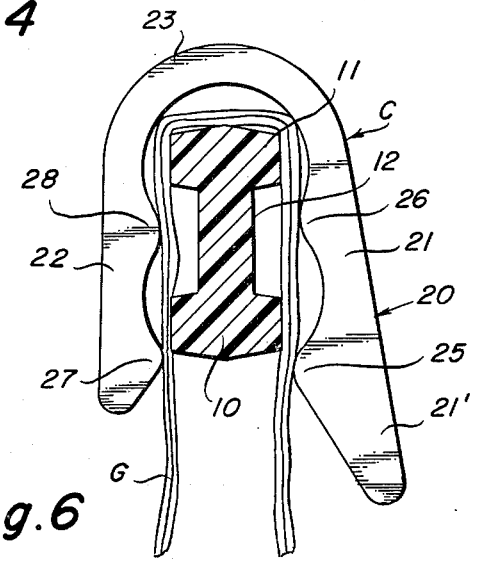
Fig. 6

PLASTIC GARMENT HANGERS WITH INTEGRALLY MOLDED CLASPS THEREFOR

This invention relates to a combined garment hanger fabricated of molded plastic material with integrally molded clasps for use therewith, which are readily detachable therefrom.

It is the object of the present invention to manufacture low-cost garment hangers which are molded of synthetic plastic material, and which include fastening clasps designed to retain the garments in place in the course of use of the hanger.

It is another object of the invention to use most efficiently the raw material necessary for the molding of the garment hangers, by deriving, in addition to the hanger body, a pair of molded clasps for use therewith, without affecting substantially the strength or appearance of the garment hanger.

It is the aim of the present invention to improve upon garment hangers of the type shown in U.S. Pat. No. Des. 210,259, Feb. 20, 1968, and U.S. Pat. No. 3,225,978, Dec. 28, 1965, by molding integral fastening clips or clasps at portions of the hanger which are generally out of direct sight, and which may readily be detached therefrom at a later time, if desired.

Other objects and purposes will appear from the detailed description of the invention following hereinafter, taken in conjunction with the accompanying drawings, wherein FIG. 1 is a front elevation of the hanger in accordance with the invention with a supporting hook riveted thereto, indicated in dotted lines;

FIG. 2 is a vertical sectional view, on an enlarged scale, along line 2—2 of FIG. 1;

FIG. 3 is a vertical sectional view, on an enlarged scale, along line 3—3 of FIG. 1;

FIG. 4 is an enlarged front elevational view of the right end of the hanger shown in FIG. 1;

FIG. 5 is an enlarged front elevational view of the hanger shown in FIG. 4, with the molded clasp separated therefrom; and FIG. 6 is a vertical sectional view along line 6—6 of FIG. 5.

In the drawings is shown a combined hanger of molded plastic material as generally known in the art and as illustrated in the above-mentioned patents, which comprises a central head portion 1 with symmetrical arms 2,3 extending laterally therefrom and which are joined to a horizontal supporting bar 4 at the corners 5 and 6. Hangers of this type are molded in complementary half-molds to form the hanger with thickened marginal edges 10 and 11 spanned by a web 12 of lesser thickness. These thicknesses may be of the order of one-fourth inch and one-eighth inch, respectively. In effect, the "I-section" of the hanger imparts maximum strength thereto for a given amount of raw plastic material employed in its formation.

A projection 7 extends upwardly from the head portion of the hanger to which is pivotally affixed a hook H by means of rivet 8 which permits rotation of the hook to afford freedom of the hanger to engage a supporting bar in a garment bag through its molded T-slot and to be selectively locked thereon by a restraining bar on the hook, as is well known.

It is the principal object of the invention to utilize the surface areas at the junctions of the horizontal bar and the ends of the arms of the hanger for molding a fastening clip or clasp C at each corner which is severable therefrom for use in fastening garments G which are supported on the horizontal bar as shown in FIGS. 5 and 6, if desired, for fastening the shoulders of the garment which is suported on the arms 2 and 3.

Since the clasps molded at each of the corners 5 and 6 are in allochirol relation, only the clasp C on the right end of the hanger will be described in detail. The clasp C′ on the left end of the hanger is derived from the enlarged surface area 16′ surrounded by the marginal edge 16 in the same manner as the clasp C is molded from the surface area within the marginal edge 15 and severed from the web 15′ as shown in FIGS. 1, 4 and 5.

The clasp C is of U-shaped contour and is formed of a pair of bifurcated legs 21 and 22 joined by the semi-circular portion 23. The lower leg 21, which is in substantial alignment with the horizontal bar 4, is longer than the leg 22. The outer marginal boundary of the clasp, which extends from the curved end of the clasp to the outer ends of the arms, is smooth, while the inner boundary of the legs is provided with opposed protuberances 25,27 adjacent the free ends of the legs, and protuberances 26 and 28 adjacent the curved end of the clasp. These rounded projections serve the purpose of engaging the garment G to enhance the clamping action against the sides of the hanger as shown in FIG. 6. The extended end 21′ of the leg 20 facilitates the disengagement of the clasp from the garment when a release from the latter is desired.

The mold plates are so designed as to provide gates for the flow of the plastic material into the spaces which mold the clasp, and as shown in the drawing, these gates form frangible tabs 31 and 32 adjacent the free ends of the legs, and 33,34 at the semi-circular head in proximity to the legs. These tabs or necks are of the same thickness as the web 15′ so that the clasps which are molded of the same thickness as that of the marginal edge 15 are readily severable therefrom.

The inner surfaces of the clasps with the undulations therein are free of any connection with the web 15′ so that no frangible tabs interconnect the inner marginal boundary with the web. However, it is desirable to reenforce the latter at its terminal end in proximity to the inner curved junction of the clasp. This is effected by a cylindrical nub 35 which is formed of the same thickness as the marginal edge 15.

While the relative dimensions of the marginal edges and webs may vary, the latter are approximately double the thickness of the webs. Thereby, desired strength characteristics are attained while effecting savings in material.

I claim:

1. A garment hanger with integrally molded clasps for cooperation therewith formed of hardened plastic material, comprising (a) a central head portion with symmetrical lateral arms sloping downwardly therefrom to the opposite ends of the hanger with an integral horizontal bar extending between said ends and forming enlarged surface areas at their junctions, (b) said lateral arms, bar and surface areas having thickened marginal edges surrounding continuous webs of lesser thickness delineated by said marginal edges, and (c) a generally U-shaped clasp molded in each of said surface areas of a thickness corresponding to that of said marginal edges, (d) each clasp being in the form of a pair of elongated substantially parallel bifurcated legs extending from a semi-circular joint with one of the legs extending in general alignment with said bar and of greater length than the other leg, and each of said legs having a smooth outer marginal boundary and an undulating inner marginal boundary, (e) each clasp also being separable from the surrounding continuous web of the enlarged surface area by a plurality of spaced frangible tabs extending between the outer marginal boundary of the clasp and the web surroundit leaving intact a substantial remanent portion of the web, (f) said tabs being of a thickness comparable to that of said web and less than that of said clasp to facilitate the separation of said clasp from the web and distributed around the outer marginal boundary of said clasp, including a tab adjacent the free end of each of the legs and a pair of tabs at the semi-circular marginal boundary in proximity to the legs, (g) the inner marginal boundaries of the legs being free of any connection with the web adjacent thereto, and said last-mentioned web terminating in a reenforcing nub of a thickness corresponding to that of the clasp or the marginal edges of the hanger.

* * * * *